US006602067B1

(12) United States Patent
Robinson

(10) Patent No.: US 6,602,067 B1
(45) Date of Patent: Aug. 5, 2003

(54) METHOD FOR IMPROVING FUEL EFFICIENCY IN COMBUSTION CHAMBERS

(76) Inventor: Barnett Joel Robinson, 227 California St., Newton, MA (US) 02458

( * ) Notice: Subject to any disclaimer, the term of this patent is extended or adjusted under 35 U.S.C. 154(b) by 0 days.

(21) Appl. No.: 10/229,700

(22) Filed: Aug. 28, 2002

(51) Int. Cl.[7] ..... F23J 7/00; C10L 1/12
(52) U.S. Cl. ..... 431/4; 44/354
(58) Field of Search ..... 431/4, 12; 44/354, 44/603

(56) References Cited

U.S. PATENT DOCUMENTS 4,295,816 A 10/1981 Robinson
4,475,483 A 10/1984 Robinson
5,085,841 A 2/1992 Robinson
5,693,106 A * 12/1997 Peter-Hoblyn et al. ..... 44/301
6,071,114 A * 6/2000 Cusack et al. ..... 431/79
6,135,760 A * 10/2000 Cusack et al. ..... 431/79
6,152,972 A * 11/2000 Shustorovich et al. ..... 44/354
6,206,685 B1 * 3/2001 Zamansky et al. ..... 431/4
6,419,477 B1 7/2002 Robinson
6,471,506 B1 * 10/2002 Zamansky et al. ..... 431/4

* cited by examiner

*Primary Examiner*—Alfred Basichas
(74) *Attorney, Agent, or Firm*—David M. Warren

(57) ABSTRACT

A method of improving fuel efficiency in combustion chambers enhances combustion of hydrocarbon fuels by introducing into the flame zone of a combustion chamber a gold compound which vaporizes and ionizes in the flame of the combusting fuel while being held by gases in the flame zone prior to and during the combustion of the fuel.

9 Claims, No Drawings

METHOD FOR IMPROVING FUEL EFFICIENCY IN COMBUSTION CHAMBERS

FIELD OF THE INVENTION

The present invention generally relates to a method of improving fuel efficiency in combustion chambers. More specifically, the present invention relates to a method of improving fuel efficiency by introducing an ionizable metallic compound wherein the ions of the metal will serve as freshly made catalyst while being held homogeneously by the gases in the flame zone during the combustion of the fuel.

BACKGROUND OF THE INVENTION

The burning of almost all hydrocarbon fuels in their respective combustion chambers is almost never complete. As a first problem related to actual combustion chambers, there are many hazardous by-products commonly produced when fuel in combustion chambers is burnt, because the fuel does not burn to completion. These by-products may include hydrocarbons, soot, smoke, carbon monoxide (CO), and oxides of nitrogen (NOx). The unburned and partially burned fuel are both the pollution from the combustion process and a financial loss to the purchaser of the fuel.

A second problem related to actual combustion chambers, such as in automotive engines or in oil fired boilers, is that these chambers have a wide distribution of parametric variation. This has been experimentally verified (by the inventor of the method of the present invention) by measuring the fuel combustion efficiency of new automobiles of the same model and of almost identical dates of manufacture.

Heretofore, these problems have dealt with the methodology disclosed in the United States patents of Robinson 4,295,816, 4,475,483, 5,085,841 and 6,419,477 wherein ionizable compounds of platinum group metals have been introduced into the flame zone of a combustion chamber to be held by the gases in the combustion process. The present invention seeks a solution to the foregoing problems without the necessity of employing a platinum group metal.

SUMMARY OF THE INVENTION

The present invention relates to a method of improving fuel efficiency in combustion chambers by reducing hydrocarbons and carbon monoxide with a precious metal catalyst other than the Group Platinum Metals but which, if desired, may be employed in conjunction with one or more catalysts of the Group Platinum Metals as well as possibly with a catalyst outside of the Group Platinum Metals. It is believed that the invention is operative by catalyzing the oxidation of hydrogen, carbon, and carbon monoxide which are present during the combustion of typical hydrocarbon fuels. In accordance with the methodology of the invention, a vaporous metallic compound of gold is introduced into the flame zone of a combustion chamber substantially homogeneously, such that the compound is held by gases in the flame zone prior to and during the combustion of the fuel, and the compound is thereby ionized prior to or during the combustion. A suitable ionizable compound of gold, which may be introduced in vaporous form to be held by the gases in the flame zone, or a mixture of ionizable compounds of gold, may be chosen from chlorides, oxides, hydroxides, and hydrates of gold, by way of example. Improved fuel efficiency is based on the amount of the gold present in the flame zone, and is obtained with a concentration of the gold compound(s) in the fuel such that there is from 0.15 to 225 mcg (micrograms) gold per kilogram of fuel.

DETAILED DESCRIPTION OF THE INVENTION

For the purpose of the present invention, a "fuel" is any substance which is exothermically oxidized in a combustion chamber. Furthermore, a fuel generally relates to compounds of carbon and/or compounds of hydrogen, as well as to carbon and hydrogen themselves.

For purposes of the present invention, "metallic compound" relates to a compound containing a constituent metal which ionizes under the physical conditions (e.g. pressure, temperature) found in combustion chambers during the fuel combustion process. For purposes of the present invention, there are many practical gold compounds which contribute to providing the desired results when introduced into a combustion chamber. Examples of such compounds may typically be chosen from the chlorides, oxides, hydroxides, and hydrates of gold.

The present invention relates to a method of improving fuel efficiency in combustion chambers, by enhancing fuel (carbon, carbon monoxide or hydrogen) combustion. This method provides for introducing a vaporous gold substance, which is either a vaporous gold compound or a mixture of vaporous gold compounds, with or without other catalysts, into the flame zone of a combustion chamber to obtain a distribution of the compound(s) within the combustion chamber substantially homogeneously, such that the compound or mixture of compounds is held by gases in the flame zone prior to and during the combustion of the fuel, and the compound or mixture of compounds is thereby ionized prior to or during the combustion.

According to one embodiment of the method of the present invention, the concentration of the gold provided by the compound or the mixture of compounds in the fuel is in a range from 0.15 to 225 mcg (micrograms) gold per kilogram of fuel.

According to the preferred embodiment of the method of the present invention, the compound or the mixture of compounds provides about 15.0 micrograms of gold per kilogram of fuel. Near optimum combustion benefits are obtained within the range of about 10–20 micrograms of gold per kilogram of fuel. Good benefits are obtained even within a larger range of about 8–24 micrograms of gold per kilogram of fuel.

According to the preferred embodiment of the method of the present invention, there is a compound of gold that is preferred in the practice of the invention, the compound being soluble in water, and homogeneously dispersed in a vaporized hydrocarbon fuel to be combusted, as well as being ionizable in the flame of combustion. The gold compound is Hydrogentetrachloroaurate ($HAuCl_4.XH_2O$).

The gold compound or the mixture of the gold compounds is introduced into the combustion chamber through one or more pathways. According to the preferred embodiment of the method of the present invention, the gold compound or the mixture of gold compounds is introduced into the combustion chamber by air flow. According to other embodiments of the invention the gold compound or the mixture of gold compounds is introduced into the combustion chamber by a stream of fuel, or by a vaporous mixture of fuel and air. Furthermore, according to other variations of the method of the present invention, the compound(s) may be introduced into the combustion chamber by using more than one pathway. For example, the catalyst compounds may be divided such that some of the components are introduced through the air flow with other components being introduced with an air-fuel mixture.

According to various embodiments of the method of the present invention, whereby the gold compound or compounds is introduced into the combustion chamber, the actual concentration of the metallic compounds may differ among the various embodiments but, preferably for efficient use of the catalysts, the mass ratio of the gold is in accordance with the formulation wherein there are about 15 parts gold per billion (thousand million) parts of fuel in the chamber during a combustion of fuel in the chamber.

The present invention will be further described and clarified in detail by the following Tables 1 and 2. Tables 1 and 2 are intended solely to illustrate the preferred embodiment of the invention and are not intended to limit the scope of the invention in any manner. The tables represent data obtained from a motor vehicle having an engine burning a hydrocarbon fuel. Table I shows pollutants CO and HC produced by combustion of fuel in the engine, and Table 2 shows improvements in power and torque produced by the engine.

TABLE 1

Volkswagon Golf 1800 Cubic Centimeter displacement 4 cylinder engine

| | Baseline | With Gold | Drop in Pollutant |
|---|---|---|---|
| Idle | | | |
| CO | 1.31% | 0.71% | 45.8% |
| HC | 246 PPM | 173 PPM | 29.6% |
| 2000 RPM | | | |
| CO | 4.94% | 4.48% | 9.3% |
| HC | 472 PPM | 403 PPM | 14.6% |
| 3000 RPM | | | |
| CO | 4.16% | 3.73% | 10.3% |
| HC | 393 PPM | 337 PPM | 14.2% |
| 4000 RPM | | | |
| CO | 4.61% | 4.27% | 7.3% |
| HC | 390 PPM | 357 PPM | 8.4% |

TABLE 2

POWER AND TORQUE

| | Baseline | With Gold | % Improvement |
|---|---|---|---|
| Power Gain @ 4,500 RPM | 40 kilowatts | 41 kilowatts | 2.5% |
| Torque Gain @ 2,700 RPM | 104 Newton meters | 108 Newton Meters | 3.8% |

The tables show experimental results comparing the performance and pollution of a Volkswagon engine using no catalyst other than the gold catalyst of the present invention under conditions of various RPM and power and torque gain.

The significance of the improvement between no catalyst and gold catalyst is expressed in the test data by significant drops in carbon monoxide and hydrocarbons. These two improvements can only be explained by a much more rapid burning of the fuel to completion. Less time is required for the CO to burn to $CO_2$, therefore, a higher percentage of the CO burns to $CO_2$. The earlier burning of the fuel means more of the produced heat is converted to work and less heat leaves the combustion chamber.

With respect to further aspects in the practice of the invention, it is noted that it may be desired to introduce a quantity of the gold compound catalyst into a fuel which may have another catalyst, such as a platinum compound catalyst disclosed in the aforementioned Robinson patents. By way of example, in the event that the fuel contains the platinum catalyst with a concentration of platinum in a range of about 4–24 micrograms of platinum per kilogram of fuel, then the minimum concentration of the gold can be reduced by one-half from the amount disclosed above. For example, if it were intended to employ the gold catalyst in a concentration of 8–24 micrograms of gold per kilogram of fuel, then, in the presence of platinum in a concentration range of 4–24 micrograms in the fuel, the concentration range of the gold can be expanded from a minimum concentration of 4 micrograms per kilogram of fuel to a maximum concentration of 24 micrograms of gold per kilogram of fuel.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

I claim:

1. A method of improving fuel efficiency in combustion chambers for enhancing the combustion of hydrocarbon fuels comprising introducing a gold substance comprising a single vaporous gold compound or a mixture of vaporous gold compounds, with or without other catalysts, via a vaporous transport into the flame zone of a combustion chamber substantially homogeneously, such that said gold substance is held by gases in the flame zone before and during the combustion of the fuel, and the gold substance is thereby ionized prior to or during said combustion, and the gold substance contains about 15 micrograms of gold per kilogram of fuel.

2. A method according to claim 1, wherein the gold substance is introduced into the combustion chamber through an air flow fed into the combustion chamber.

3. A method according to claim 1, wherein the gold substance is introduced into the combustion chamber through a stream of fuel fed into the combustion chamber.

4. A method according to claim 1, wherein the gold substance is introduced into the combustion chamber through a mixture of fuel and air fed into the combustion chamber.

5. A method according to claim 1 wherein the gold compound is hydrogentetrachloroaurate ($HAuCl_4.XH_2O$).

6. A method of improving fuel efficiency in combustion chambers for enhancing the combustion of hydrocarbon fuels comprising introducing a gold substance comprising a single vaporous gold compound or a mixture of vaporous gold compounds, with or without other catalysts, via a vaporous transport into the flame zone of a combustion chamber substantially homogeneously, such that said gold substance is held by gases in the flame zone before and during the combustion of the fuel, and the gold substance is thereby ionized prior to or during said combustion, and the gold substance contains about 8–24 micrograms of gold per kilogram of fuel.

7. A method according to claim 6 wherein the gold compounds in said mixture of vaporous gold compounds are selected from a group of ionizable compounds of gold consisting essentially of chlorides, oxides, hydroxides, and hydrates of gold.

8. A method according to claim 6 wherein the gold compound is hydrogentetrachloroaurate ($HAuCl_4.XH_2O$).

9. A method of improving fuel efficiency in combustion chambers for enhancing the combustion of a hydrocarbon fuel comprising introducing at least one vaporous gold compound via a vaporous transport into the flame zone of a combustion chamber substantially homogeneously, the fuel contains at least one vaporous platinum compound in a concentration range of 0.15–225 micrograms of platinum per kilogram of fuel, such that a mixture of the gold and the platinum compounds is held by gases in the flame zone before and during combustion of the fuel, and the gold and the platinum compounds are thereby ionized prior to or during said combustion, and providing that said at least one gold compound has a concentration of about 4–24 micrograms of gold per kilogram of fuel.

* * * * *